US008205713B2

(12) United States Patent
Gorke et al.

(10) Patent No.: US 8,205,713 B2
(45) Date of Patent: Jun. 26, 2012

(54) VEHICLE SILENCER

(75) Inventors: Peter Gorke, Stuttgart (DE); Andrei Buchhammer, Ludwigsburg (DE)

(73) Assignee: J. Eberspaecher GmbH & Co. KG, Esslingen (DE)

( * ) Notice: Subject to any disclaimer, the term of this patent is extended or adjusted under 35 U.S.C. 154(b) by 0 days.

(21) Appl. No.: 12/844,024

(22) Filed: Jul. 27, 2010

(65) Prior Publication Data

US 2011/0024227 A1 Feb. 3, 2011

(30) Foreign Application Priority Data

Aug. 1, 2009 (DE) ..... 10 2009 035 738

(51) Int. Cl.

| | |
|---|---|
| ***F01N 1/00*** | (2006.01) |
| ***F01N 5/00*** | (2006.01) |
| ***F01N 13/08*** | (2010.01) |
| ***F02B 27/02*** | (2006.01) |
| ***B21D 39/00*** | (2006.01) |
| ***B21D 51/16*** | (2006.01) |
| ***B23P 11/00*** | (2006.01) |
| ***B23P 17/00*** | (2006.01) |

(52) U.S. Cl. ..... 181/212; 181/227; 181/255; 29/520; 29/890.08; 60/272; 60/312

(58) Field of Classification Search ..... 181/212, 181/227; 29/890.08

See application file for complete search history.

(56) References Cited

U.S. PATENT DOCUMENTS

| | | | | |
|---|---|---|---|---|
| 2,739,661 | A * | 3/1956 | Powers | 181/276 |
| 2,833,368 | A * | 5/1958 | Lowther | 181/240 |
| 3,242,558 | A * | 3/1966 | Selig | 29/890.08 |
| 3,703,938 | A * | 11/1972 | Nelson | 181/274 |
| 3,897,853 | A * | 8/1975 | Frederiksen | 181/269 |
| 4,209,493 | A * | 6/1980 | Olson | 422/176 |
| 4,547,942 | A * | 10/1985 | Fukuda | 29/890.08 |
| 4,565,260 | A * | 1/1986 | Scheidt et al. | 181/243 |
| 5,579,577 | A * | 12/1996 | Preslicka et al. | 29/890.08 |
| 6,158,214 | A * | 12/2000 | Kempka et al. | 60/302 |
| 7,051,523 | B2 * | 5/2006 | Kerchner | 60/322 |
| 2001/0018827 | A1 * | 9/2001 | Rhode et al. | 60/312 |
| 2004/0168320 | A1 * | 9/2004 | Sanderson | 29/890.08 |
| 2006/0233681 | A1 * | 10/2006 | Hartmann | 422/179 |
| 2008/0196969 | A1 * | 8/2008 | Henke et al. | 181/212 |
| 2009/0032332 | A1 * | 2/2009 | Reuther et al. | 181/227 |
| 2010/0116586 | A1 * | 5/2010 | Andre et al. | 181/282 |

FOREIGN PATENT DOCUMENTS

| | | |
|---|---|---|
| EP | 1 888 891 | 2/2008 |

* cited by examiner

*Primary Examiner* — Jeffrey Donels
*Assistant Examiner* — Christina Russell
(74) *Attorney, Agent, or Firm* — McGlew and Tuttle, P.C.

(57) ABSTRACT

A silencer for an exhaust system, more preferably of a motor vehicle, is provided with a silencer insert arranged in a silencer housing. The silencer includes a jacket, with at least one pipe section penetrating a through-opening of the jacket. Through welding of the pipe section to the silencer insert a weld seam formed pressure-tight between pipe section and jacket is relieved of mechanical load.

21 Claims, 2 Drawing Sheets

VEHICLE SILENCER

CROSS REFERENCE TO RELATED APPLICATIONS

This application claims the benefit of priority under 35 U.S.C. §119 of German Patent Application DE 10 2009 035 738.6 filed Aug. 1, 2009, the entire contents of which are incorporated herein by reference.

FIELD OF THE INVENTION

The present invention relates to a silencer (or muffler) for an exhaust system, more preferably of a motor vehicle. In addition, the present invention relates to a motor vehicle with a silencer mounted transversely to the vehicle longitudinal axis.

BACKGROUND OF THE INVENTION

From EP 1 888 891 B1 a transversely positioned double-pass vehicle exhaust silencer is known. This vehicle exhaust silencer comprises a housing having a jacket and two end walls in which a silencer insert is inserted. Since the vehicle silencer is of double-pass design the jacket has two openings in each of which an inlet pipe can be inserted to which in turn the exhaust system can be connected. In order for the inlet pipes inserted in the openings to be mechanically loadable, these are fastened to associated retaining walls of the silencer insert through mechanical forming. To this end, a tool for example a type of stamping tool or circulating rollers enter the interior of the respective inlet pipe. The inlet pipe is then plastically deformed for example over the entire pipe circumference subject to the formation of a groove, wherein subject to the formation of such a groove the inlet pipe is positively or non-positively connected to the respective retaining wall. By joining the inlet pipes to the silencer insert adequately stable fixing of the inlet pipe to the vehicle exhaust silencer can be ensured. To form the vehicle exhaust silencer exhaust gas-tight the inlet pipe is additionally welded to the jacket in the region of the openings. Because of the stable joining of the inlet pipe to the silencer insert the weld seam between inlet pipe and jacket is subjected to less mechanical load and can be designed correspondingly weaker.

Disadvantageous in such positive or non-positive joining of such a pipe section designed as inlet pipe and penetrating a through-opening of the jacket is the low stability of the connection established between the pipe section and silencer insert through forming of at least the pipe section.

SUMMARY OF THE INVENTION

The present invention deals with the problem of providing an improved or at least another embodiment for an exhaust silencer (exhaust muffler) for a motor vehicle with a silencer mounted transversely to the vehicle steering axis which is more preferably characterized by higher stability of the joining region of the silencer to the exhaust system.

According to the invention, a silencer is provided for an exhaust system, more preferably of a motor vehicle. The silencer comprises a silencer housing having a jacket, a silencer insert arranged in the silencer housing and at least one pipe section penetrating a through-opening of the jacket fastened to the silencer insert. The at least one pipe section is fastened to the silencer insert through a welding method.

The invention is based on the general idea of fastening at least one pipe section penetrating a through-opening of a jacket of a silencer housing through a welding method to a silencer insert, wherein the silencer insert in circumferential direction is surrounded by the jacket of the silencer housing. Through the welding of the pipe section to the silencer insert a very stable and material-based connection between the pipe section, to which in turn the exhaust system for example can be welded, and the silencer or silencer insert is possible. Here, because of the welding, the pipe section is secured both in the direction of insertion in the through-opening as well as against twisting and tilting.

This makes possible more stable joining of the silencer to the exhaust system.

In a preferred embodiment the silencer insert comprises a pipe-like coupling section orientated towards the through-opening. The pipe section can be fitted onto this pipe-like coupling section so that the coupling section can be welded to the pipe section in the interior of the pipe section. Through this fittable design of pipe section and coupling section a more exact design of the through-opening to the outer surface of the pipe section is advantageously possible.

In an improved embodiment the jacket is additionally equipped with a socket extending to the outside in the region of the through-opening, which socket on the one hand serves as guiding aid for inserting the pipe section in the jacket and on the other hand facilitates welding of the pipe section to the jacket.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference characters refer to same or similar or functionally same components. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
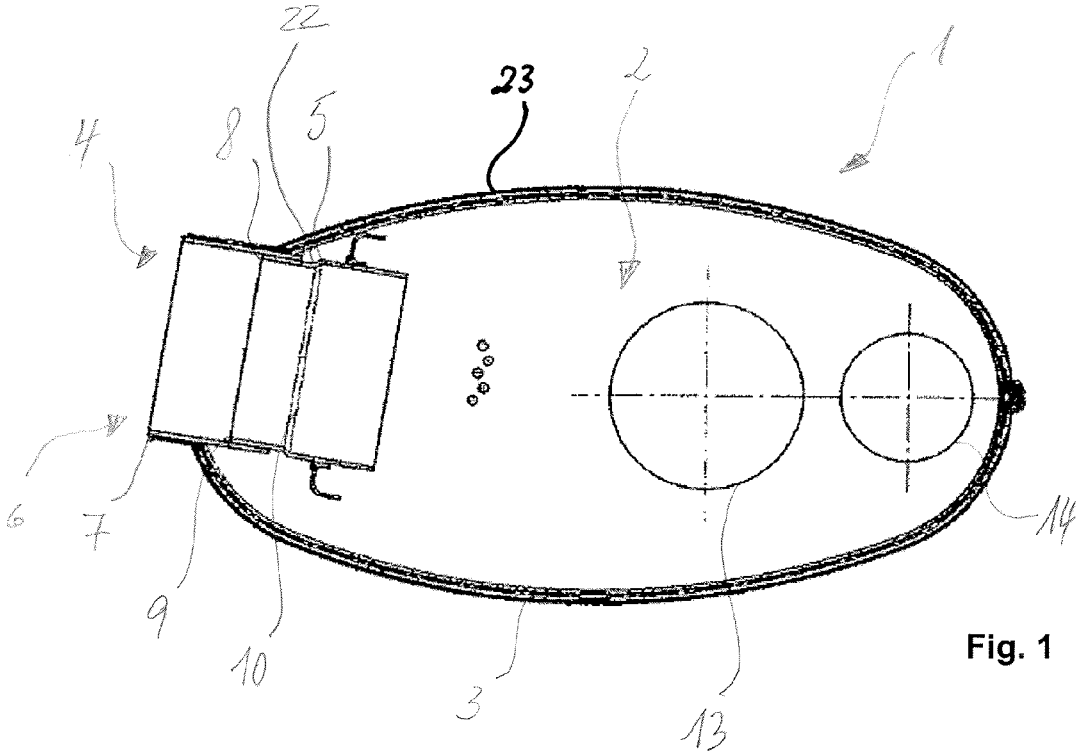
FIG. 1 is a cross sectional view through a silencer in the region of a through-opening arranged in a jacket of the silencer.

Referring to the drawings in particular, according to FIG. 1, a silencer 1 is constructed of a silencer housing 23 and a silencer insert. The silencer housing 23 comprises a circumferential jacket 3. Here, the jacket 3 can be designed cylindrically at least with respect to the inner surface so that axial sliding-in with respect to a longitudinal axis 24 of the housing 23 of the silencer insert 2 complementarily moulded to the jacket inner surface is possible. If now at least one joining region 4 of the silencer 1 to an exhaust system not shown in the Figures is arranged in the region of the jacket 3, a coupling section 5 of the silencer insert 2 cannot protrude over the jacket 3 since the silencer insert 2 can otherwise no longer be slid into the jacket 3. In order that such a silencer 1 can be unproblematically joined to an exhaust system with a joining region 4 arranged in the jacket 3 a pipe section 7, following the insertion of the silencer 1 in the jacket 3 through a through-opening 6 arranged in the jacket 3, is fitted on to the coupling section 5 through the jacket 3. Usually, with such a silencer 1, the pipe section 7 is welded to the jacket 3 in the region of the through-opening 6 so that the silencer 1 with regard to the surroundings is sealed gas-tight and no exhaust gases can thus enter the surroundings in an uncontrolled manner. Via the pipe section 7 the silencer 1 can then be joined to an exhaust system for example through welding. Through the sole fastening of the pipe section 7 to the jacket 3 a sealing weld seam between pipe section 7 and jacket 3 however is also severely loaded mechanically. In order to mechanically relieve the load of this weld seam between pipe section 7 and jacket 3 it is advantageous to render the joining of the pipe section 7 to the silencer insert 2 via the coupling section 5 so strong that through this joining of the pipe section 2 to the silencer insert 2 at least a part of the forces acting on the joining region 4 can be intercepted. Here, the pipe section 7 fitted to the coupling section 5 is preferably fastened to the silencer insert 2 or to the coupling section 5 of the silencer insert 2 through a welding method. Through the welding method a welding region 8 on an end 9 of the coupling section 5 facing the pipe section 7 is so designed that the pipe section 7 is welded to the coupling section 5. Since the pipe section 7 is fitted on to the coupling section 5 the welding region 8 is thus formed on the inner surface of the pipe section 7. Here it is practical that an outer surface of the pipe-shaped coupling section 5 is designed complementarily to an inner surface of the at least one pipe section 7 so that the pipe section 7 can be fitted on to the coupling section 5. In addition the coupling section 5 of the silencer insert 2 is orientated towards the through-opening 6.

Figure 2:
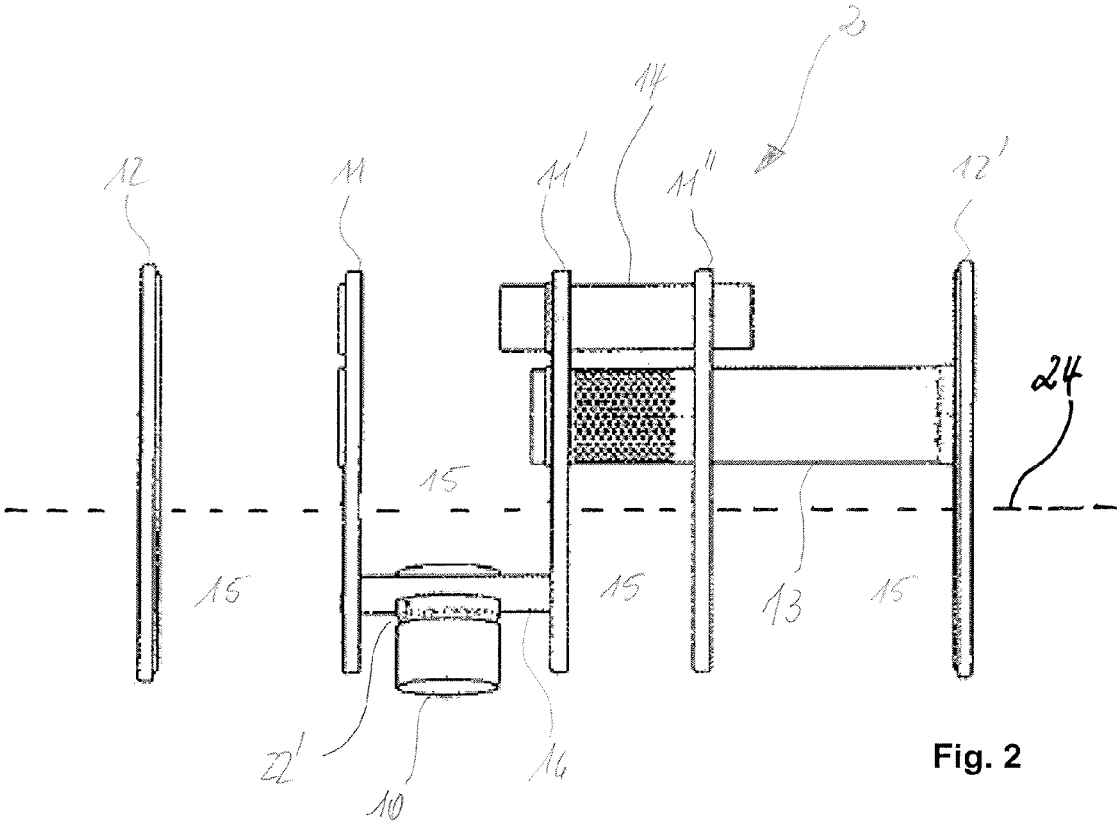
FIG. 2 is a view showing a possible design of a silencer insert with a coupling section.

In a possible embodiment the coupling section 5 is designed as a pipe piece 10 according to FIGS. 1 and 2 which is mounted to the silencer insert 2 as shown in FIG. 2 for example. A silencer insert 2 suitable for such a silencer 1 can have a plurality of intermediate bottoms 11, 11', 11" as shown in FIG. 2 and two end bottoms 12, 12' each. The end bottoms 12, 12' are part of the housing 23, wherein, before sliding the housing 23 on to the silencer insert 2 an end bottom 12 can be practically connected to the jacket 3 pressure-tight. In addition, the silencer insert 2 can comprise at least one outlet pipe 13 arranged along the longitudinal axis of the silencer 1 parallel to which a resonance pipe 14 can be arranged. In addition, the intermediate spaces 15 arranged between the end bottoms 12, 12' and the intermediate bottoms 11, 11', 11" can be filled out with an insulating material. Here, joining the pipe piece 10 via a holding console 16 of the silencer insert 2 is advantageous.

Figure 3:
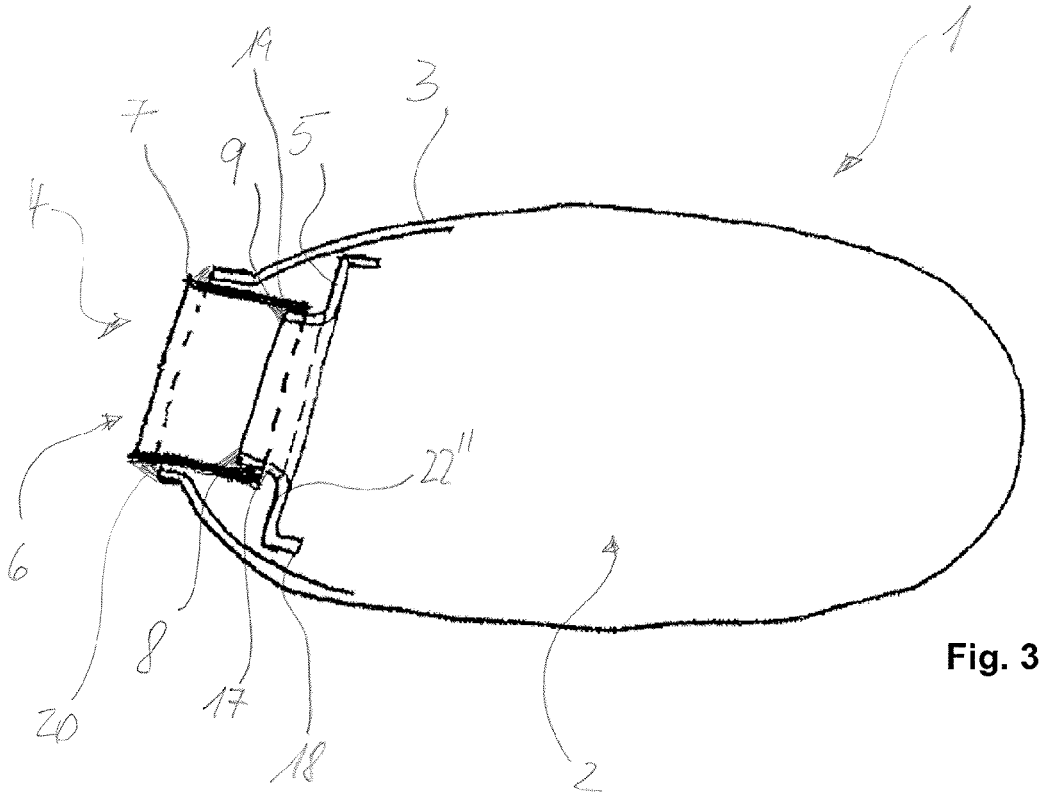
FIG. 3 is a sectional view showing a silencer with a coupling section orientated towards the through-opening and designed as a flow passage on a wall element of the silencer insert.

In an advantageous embodiment according to FIG. 3 the coupling section 5 is designed as a flow passage 17 of a wall element 18 orientated towards the through-opening 4. Advantageous in this embodiment is the in production terms simple and favourable formation of such a coupling section 5 in a wall element 18 such as the holding console 16 from for example FIG. 2. As has already been described above the welding region 8 is arranged at the end 19 of the flow passage 17 also in this embodiment. In contrast with a weld seam 20 connecting the pipe section 7 pressure-tight to the jacket 3, the welding region 8 can be designed differently. Thus it is conceivable that the welding region 8 is formed as in circumferential direction continuous orbital weld seam or as in circumferential direction interrupted weld seam. As welding method for forming the welding region 8, metal inert gas welding (MIG), metal active gas welding (MAG), tungsten inert gas welding (TIG), laser welding or arc welding can be used.

Figure 4:
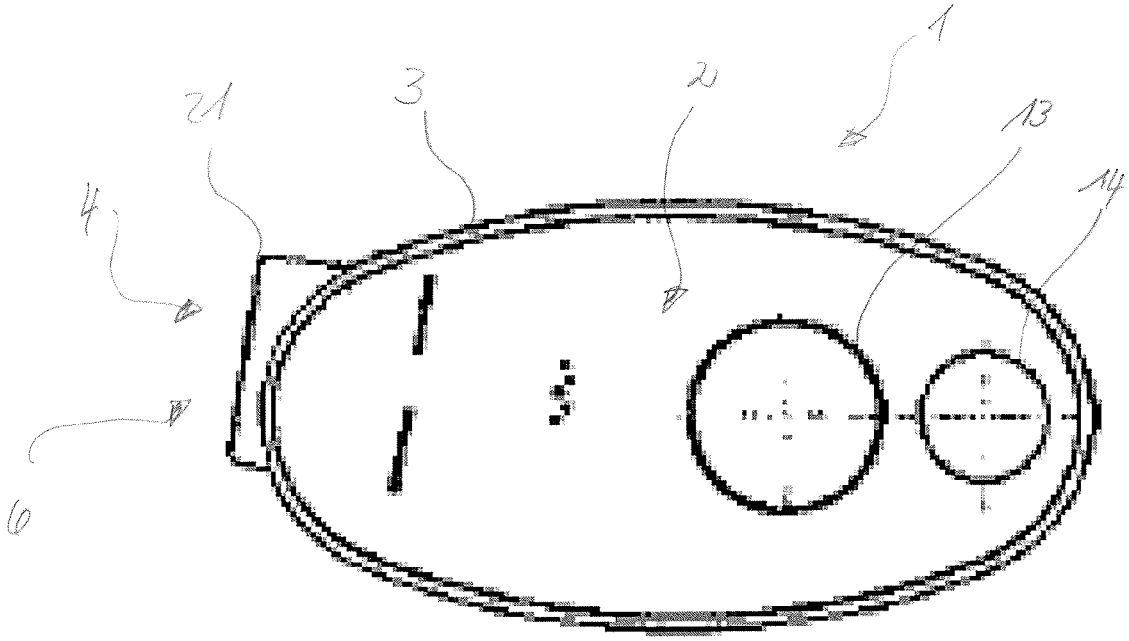
FIG. 4 is a cross section through a silencer in the region of the through-opening with a socket.

According to FIG. 4 the jacket 3 can be equipped with a socket 21 which on the one hand facilitates insertion of the pipe section 7 in the through-opening 6 of the jacket 3 and on the other hand reduces or prevents tilting of the pipe section 7 inserted in the socket 21. This facilitates the welding of the pipe section 7 both to the jacket 3 as well as to the coupling section 5.

Through a stop region 22, 22', 22", as shown in FIGS. 1, 2 and 3, the alignment of the coupling section 5 and the pipe section 7 relative to each other can be simplified during the assembly and/or during the welding. Here it is conceivable to form such a stop region 22, 22', 22" on the silencer insert 2 or on the coupling section 5. However, it is also possible to form a stop region not shown in the Figures on the pipe section 7 so that the pipe section 7 because of its stop region and for example in interaction with the socket 21 can only be fitted up to a certain depth in the jacket 3 and on to the coupling section 5.

Preferably such a silencer can be mounted in a vehicle transversely to the vehicle longitudinal axis. Here, the pipe section 7 is connected to a pipe of the exhaust system, while the outlet pipes 13 can be likewise arranged transversely to the vehicle longitudinal axis penetrating the two end bottoms 12, 12'.

In the examples shown a circular cross section each is provided for the through-opening 6, the pipe section 7, the pipe piece 10 and the flow passage 17. Other cross sections can also be realised, preferably round cross sections such as for example oval or elliptical cross sections.

While specific embodiments of the invention have been described in detail to illustrate the application of the principles of the invention, it will be understood that the invention may be embodied otherwise without departing from such principles.

What is claimed is:

1. A silencer for a motor vehicle exhaust system, the silencer comprising:

a silencer housing having a jacket with a through-opening;

a silencer insert arranged in the silencer housing; and at least one pipe section penetrating the through-opening of the jacket and fastened to the silencer insert wherein the at least one pipe section is fastened to the silencer insert through a welding method, said welding method being carried out at a position within an interior portion of one or more of said at least one pipe section and said silencer insert to form an interior weld, said interior weld being arranged in an interior portion of said at least one pipe section.

2. The silencer according to claim 1, wherein the silencer insert comprises a coupling section orientated towards the through opening, wherein on a wall element of the silencer insert, the coupling section is designed as a flow passage orientated towards the through-opening, said at least one pipe section being fastened to said coupling section via said interior weld, one end of said coupling section being arranged between said wall element and said jacket, said at least one pipe section being connected to said one end of said coupling section.

3. The silencer according to claim 2, wherein on an end of the coupling section facing the pipe section a welding region is arranged via which the respective pipe section is welded to the silencer insert.

4. The silencer according to claim 3, wherein the welding region is designed as a continuous orbital weld seam in a circumferential direction.

5. The silencer according to claim 3, wherein the welding region is designed as an interrupted weld seam in a circumferential direction.

6. The silencer according to claim 2, wherein the coupling section is spaced from the through-opening.

7. The silencer according to claim 2, wherein an outer surface of said coupling section is designed complementarily to an inner surface of the at least one pipe section, so that the pipe section is fitted on to the coupling section, said at least one pipe section having an inner pipe section surface, said inner pipe section surface being welded to said coupling section.

8. The silencer according to claim 2, wherein the coupling section is designed as a separate pipe piece which is mounted to the silencer insert.

9. The silencer according to claim 2, wherein the silencer insert comprises a stop region which delimits the fitting of the at least one pipe section on to the coupling section.

10. The silencer according to claim 2, wherein, the silencer insert and the jacket are so designed that the silencer insert can be inserted axially into the jacket with respect to a longitudinal axis of the silencer housing.

11. The silencer according to claim 2, wherein the through-opening of the jacket is equipped with a socket.

12. The silencer according to claim 2, wherein the pipe section is welded to the housing.

13. A motor vehicle having a vehicle longitudinal axis, the motor vehicle comprising:

a silencer mounted transversely to the vehicle longitudinal axis, the silencer comprising:

a silencer housing having a jacket with a through-opening;

a silencer insert arranged in the silencer housing, said silencer comprising a coupling section, and at least one pipe section penetrating the through-opening of the jacket and fastened to the silencer insert, said at least one pipe section comprising a pipe section inner surface, wherein said pipe section inner surface is welded to said coupling section at a position within one or more of said at least one pipe section and said coupling section to form an interior weld, said interior weld connecting said pipe section inner surface to said coupling section.

14. The motor vehicle according to claim 13, wherein said silencer element comprises a wall element, said coupling section being connected to said wall element, said coupling section defining a flow passage orientated towards said through-opening, one end of said coupling section being arranged between said wall element and said jacket, said at least one pipe section being welded to said coupling section at said one end of said coupling section, said coupling section having a coupling section outer surface, said coupling section outer surface engaging at least a portion of said inner pipe section surface.

15. An exhaust system silencer comprising:

a silencer housing having a jacket with a through-opening;

a silencer insert arranged in the silencer housing, said silencer insert comprising a silencer insert surface, said silencer insert surface defining an inner silencer insert portion;

a pipe section passing through the through-opening of the jacket, said pipe section comprising a pipe section surface, said pipe section surface defining an inner pipe section portion, said inner pipe section portion comprising an inner pipe section surface, said pipe section being welded at a position within one or more of said inner silencer insert portion and said inner pipe section portion to form a weld connection fastening the pipe section to the silencer insert, said weld connection extending from said inner silencer insert surface to said inner pipe section surface.

16. The silencer according to claim 15, wherein the silencer insert comprises a coupling section orientated towards the through opening and the weld connection fastens the pipe section directly to the coupling section, said weld connection engaging said inner pipe section surface and said coupling section, said coupling section having a coupling section outer surface, said coupling section outer surface engaging at least a portion of said inner pipe section surface.

17. The silencer according to claim 16, wherein:

the coupling section is spaced from the through-opening; and an outer surface of the coupling section is pipe-shaped and complementarily to an inner surface of the pipe section, so that the pipe section is fitted on to the coupling section.

18. The silencer according to claim 16, wherein on an end of the coupling section facing the pipe section a welding region is arranged at which the weld connection is provided with the pipe section welded to the silencer insert, said silencer insert comprising a wall element, said coupling section being integrally connected to said wall element, said coupling section defining a flow passage, said flow passage being orientated towards said through-opening, one end of said coupling section being arranged between said wall element and said jacket, said weld connection being in contact with said one end of said coupling section.

19. The silencer according to claim 16, wherein, the silencer insert and the jacket are shaped so that the silencer insert can be inserted axially into the jacket with respect to a longitudinal axis of the silencer housing.

20. The silencer according to claim 16, further comprising another weld wherein the pipe section is welded to the housing via the another weld.

21. A silencer for a motor vehicle exhaust system, the silencer comprising:

a silencer housing having a jacket with a through-opening;

a silencer insert arranged in the silencer housing; and at least one pipe section penetrating the through-opening of the jacket and fastened to the silencer insert wherein the at least one pipe section is fastened to the silencer insert through a welding method, said welding method being carried out at a position within an interior portion of one or more of said at least one pipe section and said silencer insert, wherein the silencer insert comprises a coupling section orientated towards the through opening, wherein on a wall element of the silencer insert, the coupling section is designed as a flow passage orientated towards the through-opening, said at least one pipe section being welded to said coupling section, one end of said coupling section being arranged between said wall element and said jacket, said at least one pipe section being connected to said one end of said coupling section.

* * * * *